United States Patent [19]

Irvine et al.

[11] Patent Number: 4,688,708

[45] Date of Patent: Aug. 25, 1987

[54] BURSTING MACHINE

[75] Inventors: Robert Irvine, Riverside; Robert E. Mersereau; Frank T. Roetter, both of Westport; Harold Silverman, Wilton, all of Conn.

[73] Assignee: Pitney Bowes Inc., Stamford, Conn.

[21] Appl. No.: 908,893

[22] Filed: Sep. 18, 1986

Related U.S. Application Data

[63] Continuation of Ser. No. 569,102, Jan. 9, 1984, abandoned.

[51] Int. Cl.[4] ..... B26F 3/02; B65H 35/10

[52] U.S. Cl. ..... 225/100; 225/106; 493/22; 493/410

[58] Field of Search ..... 225/100, 101, 106; 493/21, 22

[56] References Cited

U.S. PATENT DOCUMENTS

| | | | |
|---|---|---|---|
| 2,771,950 | 11/1956 | Smith | 225/100 |
| 3,481,520 | 12/1969 | Pickering | 225/4 |
| 3,484,031 | 12/1969 | Pine | 225/100 |
| 3,987,949 | 10/1976 | Manning et al. | 225/106 |
| 4,025,023 | 5/1977 | Moffitt | 225/100 |
| 4,261,497 | 4/1981 | Roetter et al. | 225/100 |
| 4,284,221 | 8/1981 | Nagel et al. | 225/100 |
| 4,454,973 | 6/1984 | Irvine | 225/100 |

*Primary Examiner*—Frederick R. Schmidt
*Assistant Examiner*—William E. Terrell
*Attorney, Agent, or Firm*—Lawrence E. Sklar; David E. Pitchenik; Melvin J. Scolnick

[57] ABSTRACT

A bursting machine is provided for separating discrete sheets from a continuous strip of sheets having uniformly spaced perforation lines across the width of the strip. A gauging device with numerical increments in the form of a linear scale is manually compared to the length of the discrete sheets to provide a predetermined number corresponding to a pulse count for entering into a control device through a manually settable device. The control device in turn is operatively connected to an electronic pulse counter. When the leading edge of the strip advances a predetermined increment after passing through a sensing device located downstream in the path of travel with respect to a first pair of feed rollers, a pulse generator attached to the driven first feed roller is actuated to generate pulses for counting to reach the preset number in the pulse counter. When the preset number is reached, a second pair of feed rollers is stopped through disablement of an electromagnetic clutch and enablement of a brake while the leading sheet is continued to be conveyed downstream by the first pair of feed rollers to effect a burst.

5 Claims, 4 Drawing Figures

BURSTING MACHINE

This is a continuation of application Ser. No. 569,102, filed Jan. 9, 1984, and now abandoned.

BACKGROUND OF THE INVENTION

1. Field of the Invention

The present invention relates to bursting machines for continuous, perforated strips which are typically provided from computers as printed output documents in fan-folded form.

There is a tremendous amount of printed material generated by computers, and the material is substantially growing as the use of computers grows. Correspondingly, there is a great variety of type and size of continuous perforated strips which must be processed through a bursting machine in order to separate the individual sheets from the strip.

In particular, there is a great variation in respect to the lineal length dimension of the discrete sheet between perforations. The length variation requires that a bursting machine be adjusted to compensate for the changing position of the perforation line in the path of travel of the strip of sheets being conveyed through the bursting machine. To date, the requirement of the adjustment described, and the manner for accomplishing the adjustment is time consuming, awkward and creates a potential for making errors.

2. Description of the Prior Art

The earliest forms of bursting machines representing the prior art have typically been adapted to handle continuous, perforated strips wherein there was known but one length of sheet. There was no requirement therefore to adjust a bursting machine for alternate sheet lengths because of alternate supplies of perforated strips. As more use of computers evolved however, there was an increase in varying lengths of the sheets within the strip depending on the requirements of public serving companies requiring billing material for customers and other computer printout data of varying scope and complexity.

Eventually, bursting machines evolved having a mechanical adjusting apparatus built into the machine which required an operator to take certain steps to accommodate the material to be burst. The steps did not include reference to a gauge or similar guide to make the task easier.

Still later versions of bursting machines are adjustable, and do provide a gauge which is referred to by the operator when determining where the strip is to be burst. Typically however, the gauge is utilized in combination with the adjustment and is accomplished by moving at least one pair of feed rollers which carries the continuous strip. This is a relatively awkward, time consuming and cumbersome task for an operator, which leaves a problem still unsolved until the present invention.

3. The Prior Art

U.S. Pat. No. 3,481,520, issued to Pickering on Dec. 2, 1969, discloses a process and apparatus for severing sheets of uniform lengths from a moving web of material. The patent discusses use of a preset counter and a cooperating pulse generator to measure off the desired length of a separate sheet. However, there is no apparatus or description provided as to how to preset the counter to accommodate a continuous perforated strip. In addition, it is required that the strip be severed, thereby adding apparatus to the machine, which is unnecessary with the present day use of perforated strips that are easily torn apart.

Another issued patent, U.S. Pat. No. 4,025,023 to Moffitt on May 24, 1977 relates to a bursting machine having the second feeding means operable to a faster rate than the first. The increased speed of the second feeding rollers is faster than the strips predetermined speed, and is applied at a time controlled by activation of those rollers by a signal from a central device. While there is no adjustment of the roller spacing described, it is implied that a push button on a control panel be used to accommodate different sheet lengths. However, there is no accompanying apparatus, description nor procedure provided to implement the idea.

Yet another U.S. Patent, U.S. Pat. No. 4,284,221 to Nagel et al on Aug. 18, 1981, discloses a bursting machine which utilizes a counter for transmitting actuating signals at regular intervals when feeding a web at constant speed. The web has sheets of equal lengths, and there is a sheet length measuring device mentioned, but not shown or described. Again, to the extent that this subject is mentioned, it is entirely unclear how the length measuring device is constructed or utilized. Therefore, the problem of providing an "operator friendly" system to accommodate varying sheet lengths within different continuous perforated strips has remained unsolved until the present invention.

SUMMARY OF THE INVENTION

The present invention relates to a bursting machine for separating continuous strip stationery along a transverse line of perforations which joins the individual sheets. The bursting machine has two pairs of non adjustable rollers for conveying the strip therethrough. The first pair of feed rollers are continuously driven, and the second pair is intermittently driven. Beyond the first pair of feed rollers, a sensing device detects the leading edge of the sheet and sends an appropriate signal to a pulse counting device within which a predetermined count is also entered by the operator prior to operation of the machine. The predetermined count represents a number, selectively entered through a settable device connected to the pulse counter. The operator determines the number by comparing the length of a discrete sheet in the strip to a sheet length gauge having numerical increments representing varying sheet lengths. At the same instant that the leading edge of the strip is sensed, a pulse generator connected to the first pair of feed rollers is signaled by the pulse counter to generate pulses. When a pulse count is reached that is coincident with the predetermined count set into the pulse counter, actuators connected to the second pair of feed rollers disable them to allow the first pair of feed rollers to effect the sheet burst as they convey the sheet away from the strip.

The broader extent of the present invention relates to a bursting machine for separating discrete sheets from a continuous strip of sheets having uniformly spaced perforation lines across the continuous strip. There is a first and second pair of feed rollers spaced apart and disposed in the burster for conveying the strip along a path of travel. The second pair of feed rollers is intermittently driven by connecting actuating devices. A sensing device is disposed in the path of the continuous strip for sensing the arrival of the leading edge of the strip of sheets at a point downstream of the first pair of feed rollers. There is a control device for causing the actuating device to start and stop the second pair of feed rollers in order to stop and start the feeding of the continuous strip with respect to the arrival of the leading edge of the strip of sheets at the sensing device. And, there is a device for setting the control device to vary the predetermined timed relationship and therefore a predetermined distance in accordance with the length of a sheet as determined by the distance between adjacent perforations between individual sheets. The control device furthermore causes the actuating device to stop the second pair of feed rollers when a perforation line is at a predetermined location intermediate the first and second pairs of feed rollers to effect a burst of a sheet from the continuous strip at the perforation line. The control device is responsive to the arrival of the leading edge of a sheet at the sensing device for commencing a predetermined time interval after which a perforation line is disposed between the first and second pairs of feed rollers and the second pair of feed rollers is stopped to cause bursting of the sheet from the strip. The control device which commences the predetermined time interval includes a pulse generator operatively connected to the first pair of feed rollers, and to a pulse counter which counts in response to the sensing device sensing the leading edge of a sheet and to generate a signal in response to counting a predetermined number of pulses. The signal causes the actuating device to stop the second pair of feed rollers.

In addition, the control device includes a gauging device for establishing a predetermined number of pulses for any given length of sheet as defined by the distance between adjacent perforation lines on the continuous strip. And, there is a manually settable device for entering the predetermined number of pulses into the pulse counter to cause the pulse counter to generate a signal after having counted the predetermined number of pulses.

With the foregoing in mind, it is a principal object of the present invention to provide a bursting machine which overcomes the deficiencies of the prior art.

It is an object of the present invention to provide a bursting machine having manually settable controls for effecting a burst on a perforated line in a continuous strip.

It is a further object of the present invention to provide a bursting machine having a gauging device for determining a predetermined pulse count corresponding to the length of a sheet as defined by the distance between transverse perforation lines in a continuous strip where the count is selectively entered through a manually settable control.

FIGS. *2a–2c* generally represent three separate schematic phases of the operation of the bursting machine representing the present invention where:

FIG. *2a* schematically illustrates a transversely perforated continuous strip positioned with its leading edge at a sensing device, adjacent to the first pair of feed rollers in the path of travel of the strip.

FIG. *2b* schematically illustrates that portion of a bursting cycle when the second pair of feed rollers has been stopped by an actuating device and a sheet from the perforated continuous trip is burst while the perforation line of the sheet is intermediate the first and second pairs of rollers.

FIG. *2c* further schematically illustrates a later period of a bursting cycle when the trailing edge of a burst sheet is passing over the downstream sensing device, and is causing the second pair of rollers to initiate another feed cycle by releasing the brake and actuating the operatively connected feed clutch.

DESCRIPTION OF THE PREFERRED EMBODIMENT

Figure 1:
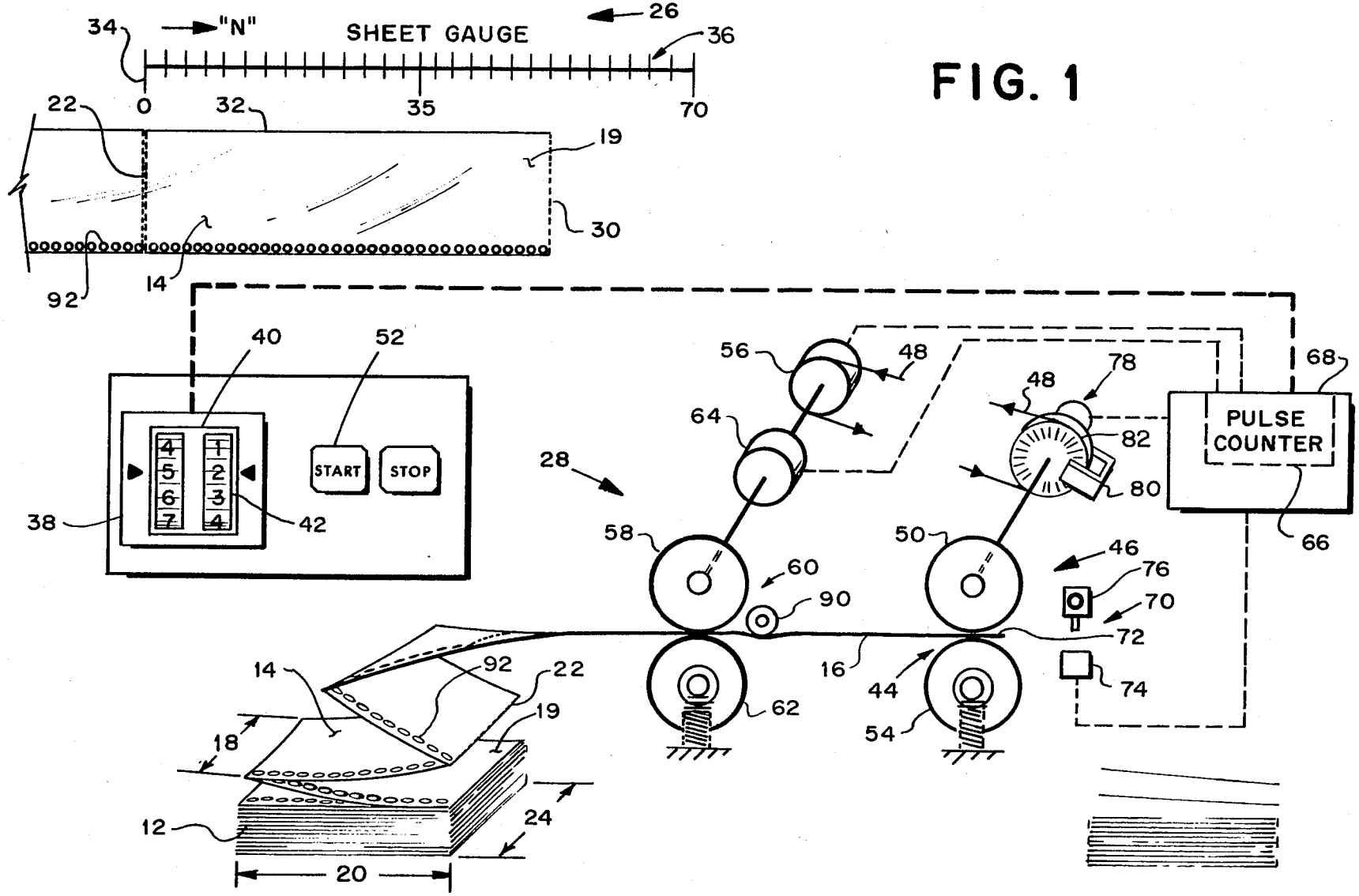
FIG. 1 represents a schematic side view of the principal devices constituting the bursting machine.

Referring to FIG. 1, there is a schematic drawing representative of a bursting machine 10 having instrumentalities which will be defined in detail henceforth for the purposes of setting forth a convenience to the operator in terms of set up and control of a bursting operation. There is no architectural machine structure shown in the accompanying drawings for it is felt that it is not necessary to define structure as such in order to demonstrate the applicability of the present invention.

A supply stack 12, constituting a continuous strip of sheets 14 is positioned to follow a path of travel 16 through the bursting machine 10. Along the path of travel 16, there are strip conveying rollers, one pair of which is operatively stopped and started to effect a burst of the strip 14 as such at a predetermined position.

As is so well known to those skilled in the art, the continuous strip of sheets 14 is perforated along a transverse line 18 between each sheet. The relative length of a discrete sheet 19 is illustrated given by a lengthwise side 20 of the supply stack 12 as it is aligned in a parallel direction with respect to the path of travel 16. Typically the supply stack 12 is formed of the discrete sheets folded in a fan folded arrangement, since a perforated line 22 across a width 24 of the strip 14 easily bends to form such a fold.

There is an endless variation of lengths of such continuous perforated strips provided in the form of computer print out material as previously mentioned and accordingly the prior art has manual machine adjustments built into the previously known burster machines to compensate for the difference. Unfortunately, the machine adjustment is provided by having the operator manually realign at least one pair of conveying rollers or a tractor drive which is sometimes used to drive the strip through evenly spaced holes located at the edges of the strip. The present invention however, has eliminated the adjustments described, thereby allowing a machine operator to establish the bursting machine 10 set up as it is required to facilitate a burst of the discreet sheet 19 no matter what the length of the sheet 19 is.

There is a clearly defined and rapid procedure now presented for establishing the burst location for the strip 14 as such. Initially, the operator is directed to a sheet gauge 26 which is part of a control device to be described later in the present specification. The gauge 26 is located on any convenient external location on the bursting machine 10. Overall, this is an "operator friendly" system and is facilitated by the sheet gauge 26, which is clearly marked, and easy to read. In the present specification it is intended that the sheet gauge 26 be positioned near an upstream side 28 of the path of travel 16 through the machine 10 as such. The procedure begins when the operator takes a free end 30 of the strip 14 and registers the discrete sheet 19 alongside of the sheet gauge 26. For example, in FIG. 1 the free end 30 of a strip 14 is partially shown alongside of the sheet gauge 26 where an edge 32 of the strip 14 is positioned with a perforated line 22 aligned with a "zero mark" 34. The sheet gauge 26 has a lineal scale 36 calibrated in numerical increments representing varying lengths of discrete sheets.

A numerical increment "N" is then read from the linear scale 36, the numerical increment "N" representing a predetermined pulse count which can be entered into a settable control means as pulse count data. Since each pulse represents a small increment of the strip, the predetermined measured increment of the strip 19 which must be fed in order to bring a perforation line 22 to a desired location for bursting. The numerical increment "N" is then entered into a control panel 38 conveniently located at the upstream side 28 of the machine 10, the control panel 38 having a manually settable device 40 which has a number of settable elements 42 such as rotatable thumbwheels. The settable device 40 has the capability of generating pulse count data which is transmitted to a control means described below. There is a 0 to 10 value clearly printed on each thumbwheel, for selecting the value represented by "N". The pulse count data is generated in regular unit level increments, that is, each numerical unit on the thumbwheels represents a pulse, so that any number of pulses from 1 to 99 in increments of 1 can be selected for transmission to the control means described below. For example, an 11 inch long sheet might, for example be represented by the number 64 on the linear scale 36 and be entered as such to the manually settable device 40. The next step is for the operator to lead the strip 14 into the bursting machine 10 which is easily accomplished by aligning the center of the strip with a center mark (not shown) located in the area of the upstream side 28 of the burster machine 10. At this point, the strip is then manually placed into the path of travel 16 where the appropriate conveying rollers automatically handle it.

There are several pairs of rollers for conveying the strip 14, for example a first pair of continuous driven feed rollers 44 is located at a downstream side 46 of the bursting machine 10 as such. A main drive system 48, (partially shown) is connected to an upper roller 50 of the first pair of continuously driven feed rollers 44 so that continuous rotation of the rollers 44 as such occurs when a start button 52, located on the control panel 38 and operatively connected to the main drive system 48, is pushed. There is a lower roller 54 resiliently biased against the upper roller 50, thereby providing sufficient pressure to convey the strip 14. It will be understood to those skilled in the art that the upper and lower rollers 50 and 54 are suitably covered by rubber, or an equivalent material such as urethane for positive drive of the strip 14. The same main drive system 48 is connected to an actuating device comprised of an electromagnetic clutch 56, which is suitably mounted on an upper roller 58, of a second pair of intermittently driven feed rollers 60, located in fixed, spaced relationship with respect to the first pair of continuously driven feed rollers 44. There is a lower roller 62, resiliently biased against the upper roller 58, and an actuating device comprised of an electromagnetic brake 64 suitably mounted to the upper roller 58, for operation to now be described along with the clutch 56 as such.

Typically both the clutch 56 and brake 64 are 24 VDC which is readily adaptable to any electronic control device having pulse counters. There is a pulse counter 66 within a control device 68 for receiving and storing the pulse count data generated by the settable device 40. As will be seen in more detail below, the control device 68 controls the length of time that the electromagnetic clutch 56 is enabled as well as the length of time that the electromagnetic brake 64 is disabled and during another time, when the clutch 56 is disabled and the brake 64 is enabled. The enabling and disabling of the respective actuating devices, in the form of the clutch 56 and brake 64 thus provides an intermittent drive to the second pair of intermittently driven feed rollers 60.

Figure 2A:
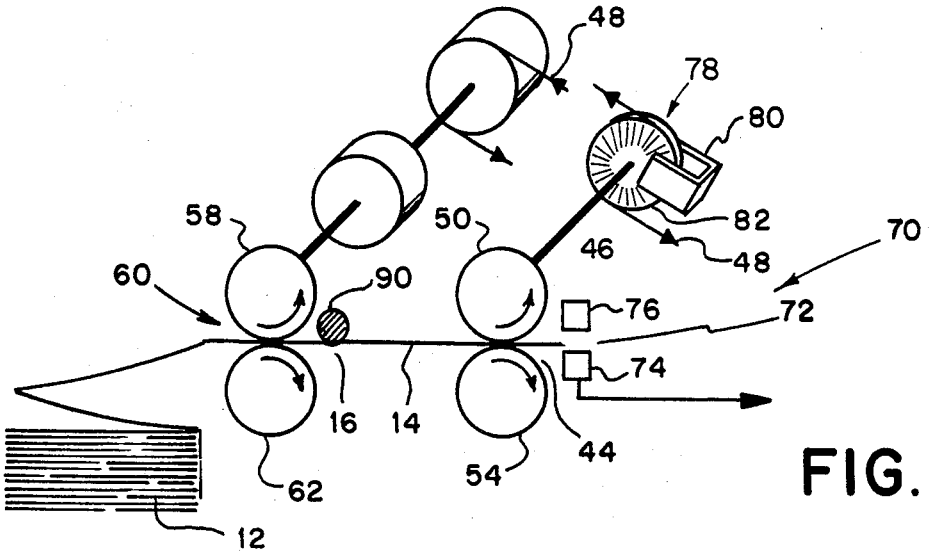

A sensing device 70 which is also part of a control device 68, is located at the downstream side 46 of the machine 10, in order to determine when a leading edge 72 (FIG. 2*a*) of the strip 14 is in position to initiate a signal to the control device 68 to effect a burst. The sensing device 70 is comprised of a photo cell receiver 74 and a cooperating illumination device 76 which is responsive to arrival of the leading edge 72 of the strip 14 to cause a signal to be generated and sent to the control device 68. It will be noted that the sensing device 70 is disposed downstream of the first pair of continuously driven feed rollers 44, which insures that the strip 14 is positively driven at all times and that a sheet or the strip 14 is in the nip of the rollers 44.

Figure 2B:
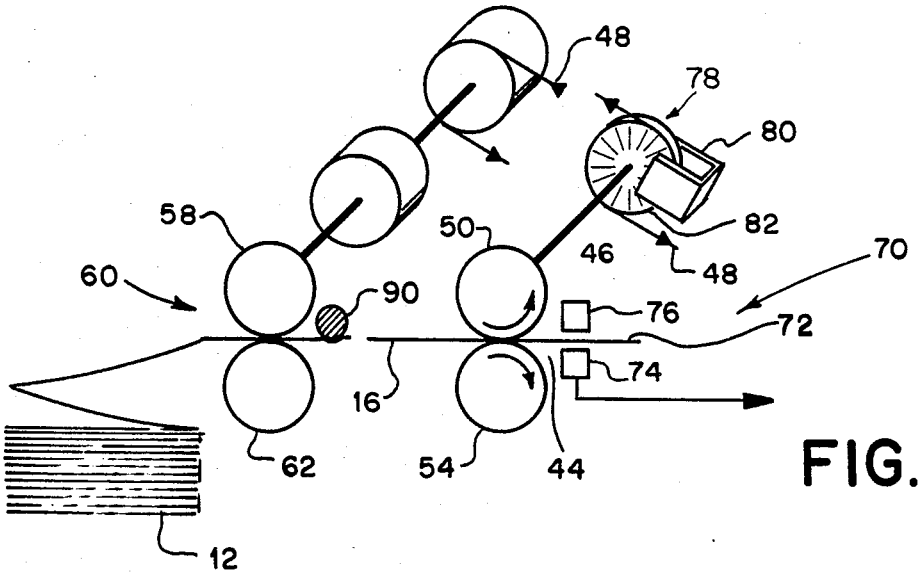
Figure 2C:
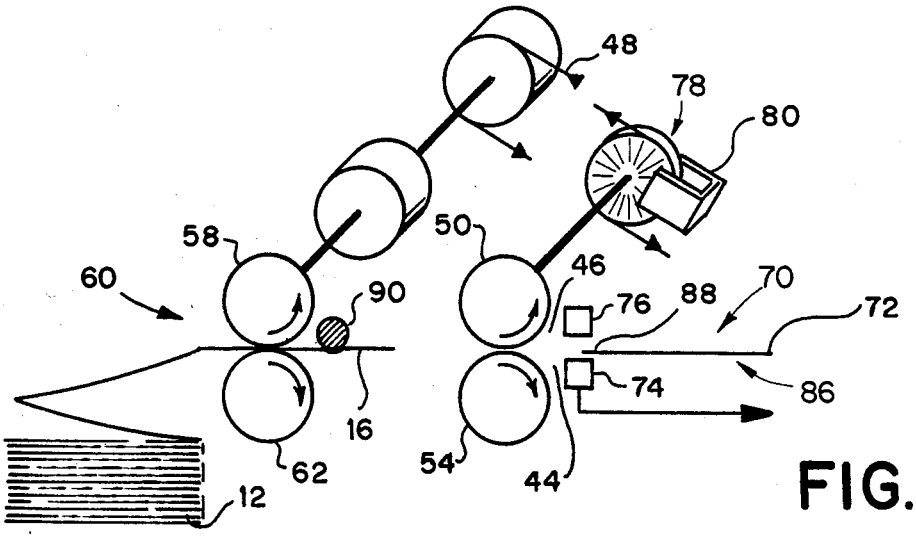

There is a pulse generator 78, comprised of a slotted wheel 82 suitably attached to the upper roller 50, for operating in conjunction with an optical interruptor 80 for the purpose of sending pulses to the pulse counter 66. The pulse generator 78 is operatively associated with the continuous strip 14 to generate pulses in response to movement of the strip 14 along the path of travel 16. At the instant that a signal is generated in recognition of the passage of the leading edge 72 of the strip 14, commencement of a time interval is started wherein the signal is sent and received at the control device 68 where a command is given to begin a pulse count by the pulse generator 78 until coincidence is reached with the predetermined number of pulses represented by the number "N", previously set by the operator into the control device 68. Expressed differently, for any given length of sheet measured against the linear scale 36, an arbitrary number "N" is obtained which is entered into the settable device 40 which is then transmitted to and stored in the control device 68, this number "N" being a predetermined pulse count which represents a corresponding predetermined measured increment of the strip 14 which must be fed after the leading edge 30 of the strip 14 passes the sensing device 70. When the sensing device 70 senses the passage of the leading end of strip 14, the pulse counter 66 commences to count the pulses generated by the pulse generator 78, and when the count of pulses from the pulse generator 78 equals the predetermined pulse count "N" stored in the control device 68, the electromagnetic clutch 56 is disabled, and the electromagnetic brake 64 is enabled to cause the second pair of feed rollers 60 to stop. At this instant, the remainder of the perforated strip 14 stops while the leading edge 72 continues (FIG. 2*b*) being conveyed by the first pair of continuously driven feed rollers 44. Therefore, a sheet 86 is separated from the strip 14, as seen in FIG. 2*c* where, in addition a trailing edge 88 of the sheet 86 is seen to be uncovering the sensing device 70 to send a signal to the control device 68, which in turn causes a new bursting cycle to begin. To this extent, as seen in FIG. 2*c*, the electromagnetic brake 64 is disabled and the electromagnetic clutch 56 is enabled which immediately causes the strip 14 to be conveyed downstream by the second pair of intermittently driven feed rollers 60 towards the first pair of continuously driven feed rollers 44.

There is an alternate way of generating pulses in the bursting machine, which entails use of a series of apertures 92, otherwise known as sprocket holes which are normally part of a continuous strip such as the strip 14. The series of apertures 92 is disposed along at least one edge of the strip 14, as seen in FIG. 1. It is intended that the series of apertures 92 work in association with the optical interrupter 80 which would be conveniently relocated to sense the apertures 92, similar to the described function of the slotted wheel 82. The optical interruptor 80 would be located at a lateral edge of the strip 14 to align with the aperture 92 for the purpose of generating pulses to be utilized by the pulse counter 66 for the same purpose as has been set forth in the prior description.

It will be recognized by those skilled in the art that at the instant the count "N" is reached, the perforation line 22 of the strip 14 is disposed adjacent a suitable bursting cone 90, which helps to break the sheet 86 away from the remainder of the strip 14 during the actual burst.

When a burst assist device such as bursting cone 90 is used, the spacing between the bursting cone and the location at which the sensor 70 senses the leading edge 72 of the strip must be taken into account when setting up the sheet gauge and pulse counter. This must be done to assure that the distance the strip travels after the leading edge 72 is sensed equals the length of a sheet of the strip, minus the distance between the bursting cone and the location at which the leading edge is sensed. The pulse count "N" which is preset is then a predetermined count equal to this travel distance, i.e. the length of a sheet, minus the distance between the bursting cone and the location at which the leading edge of the sheet is sensed.

In accordance with the objects of the invention, there has been described a bursting machine 10 for continuous perforated strips of uniform length, the machine having a control device including a gauging device for determination of a number representing a sheet length which is to be entered into the control device to effect a burst without having to make substantial adjustments of the bursting machine. Inasmuch as certain changes may be made to the apparatus described in the present specification, in order to achieve the same effect, it is intended that all matter contained in the above description or illustrated in the accompanying drawings be captured in the spirit and scope of the following claims.

What is claimed is:

1. A bursting machine for separating discrete sheets of any predetermined length from a continuous strip of sheets having substantially uniformly spaced perforation lines traversing the width thereof, comprising:

A. a first pair of stationary, feed rollers disposed in a path of travel for the continuous strip;

B. a second pair of stationary, feed rollers disposed in said path of travel in fixed, spaced relationship upstream of said first pair of feed rollers;

C. means connected to at least one roller of said first and second pairs of rollers for driving both of said pairs of rollers;

D. actuating means connected to at least one roller of said second pair of rollers for alternately starting and stopping said second pair of rollers to thereby alternately start and stop the feeding of said continuous strip;

E. means disposed in said path of travel downstream and adjacent said first pair of rollers for sensing the arrival of the leading and trailing edges of the leading sheet of the continuous strip at a predetermined position;

F. settable control means for said bursting machine;

G. means for entering and storing a predetermined pulse count number representative of any predetermined length of a discrete sheet within said continuous strip of sheets in said control means;

H. means for cyclically generating a pulse count whenever the leading edge of the leading sheet of said continuous strip arrives at said predetermined position;

I. means for comparing said predetermined pulse count number stored in said control means to said generated pulse count;

J. means for generating a signal to energize said actuating means to stop said second pair of rollers and thereby stop the feeding of the continuous strip when the generated pulse count has reached the predetermined pulse count number, whereby a discrete sheet is separated at a perforation line from said continuous strip when said perforation line is at a predetermined location intermediate said first and second pairs of rollers; and K. means for generating a signal to energize said actuating means to re-start said second pair of rollers and thereby re-start the feeding of the continuous strip when the sensing means senses the arrival of the trailing edge of the leading sheet of the continuous strip, whereby a new cycle of sheet separation is initiated.

2. The bursting machine of claim 1 wherein said pulse count generating means is connected to said driving means for successively generating pulses in response to movement of the continuous strip along said path of travel.

3. The bursting machine of claim 2 additionally comprising gauging means for establishing said predetermined pulse count number.

4. The bursting machine of claim 3 wherein said gauging means comprises a linear scale calibrated in numerical increments against which a sheet is measured to determine a number of such numerical increments constituting said predetermined pulse count number.

5. The bursting machine of claim 4 wherein said actuating means comprises an electromagnetic clutch and brake.

* * * * *